US005820027A

United States Patent [19]

Szczurek

[11] Patent Number: 5,820,027

[45] Date of Patent: Oct. 13, 1998

[54] FOAM FIRE NOZZLE

[76] Inventor: Norbert Szczurek, Box 1996, Truckee, Calif. 96160

[21] Appl. No.: 645,534

[22] Filed: May 14, 1996

[51] Int. Cl.[6] ..... B05B 1/14; E03C 1/08

[52] U.S. Cl. ..... 239/428.5; 239/553.3; 239/553.5; 169/15

[58] Field of Search ..... 239/343, 428.5, 239/462, 463, 504, 553, 553.5, 553.3; 169/15, 70

[56] References Cited

U.S. PATENT DOCUMENTS

| | | | |
|---|---|---|---|
| 2,829,874 | 4/1958 | Freeman | 239/504 X |
| 2,839,334 | 6/1958 | Lacks et al. | 239/504 X |
| 3,388,868 | 6/1968 | Watson et al. | 239/428.5 X |
| 4,830,790 | 5/1989 | Stevenson | 239/428.5 X |
| 5,054,688 | 10/1991 | Grindley | 239/47 |
| 5,330,105 | 7/1994 | Kaylor | 239/400 |
| 5,417,371 | 5/1995 | Brackett | 239/391 |
| 5,445,226 | 8/1995 | Scott et al. | 169/15 |

*Primary Examiner*—Andres Kashnikow
*Assistant Examiner*—Robin O. Evans
*Attorney, Agent, or Firm*—David H. T. Wayment

[57] ABSTRACT

A foam nozzle for fighting fires is disclosed. The nozzle has an over-all conical shape, with a plurality of air holes and a plurality of agitation screens. The nozzle is simply slipped over the end of the traditional non-foam nozzle and held in place with a thumb screw or similar device.

3 Claims, 2 Drawing Sheets

FOAM FIRE NOZZLE

BACKGROUND OF THE INVENTION

1. Field of the Invention.

This invention relates generally to the field of fire fighting equipment and, specifically, to nozzles for spraying foam.

2. Description of Related Art.

From time immemorial, mankind has used water to extinguish fires. In modern firefighting units, water still plays a central role in putting out fires. With certain types of fires, however, modern firefighters have found it advantageous to add foaming agents to the water. The addition of foaming agents allows firefighters to apply a thick layer of watery foam to a fire, cooling the fire and robbing it of the oxygen which is essential to combustion.

Arguably, the most important component of a foam application system is the foam nozzle which is attached to the terminal end of a water hose. The foam nozzle performs two critical functions. First, the nozzle mixes the water/foaming agent combination with air. Second, the nozzle agitates the air, water and foaming agent to produce foam. The prior art foam nozzles, while filling a critical need, have been subjected to criticism from firefighters on a number of grounds. The prior art nozzles tend to be expensive. The prior art nozzles tend to be difficult to use: often, the prior art nozzles require that the non-foam nozzle be removed from the hose and replaced with the foam nozzle. Most importantly, however, the fire fighting community has long felt that the prior art nozzles simply did not do a good enough job of producing foam.

For the foregoing reasons there has been a need for a foam nozzle which was inexpensive, could be quickly and simply attached to the existing nonfoam nozzle, and did a better job of making foam than the prior art nozzle.

SUMMARY OF THE INVENTION

A foam nozzle satisfying the foregoing needs is disclosed. The nozzle has an over-all conical shape, with a plurality of air holes and a plurality of agitation screens. The nozzle is simply slipped over the end of the traditional non-foam nozzle and held in place with a thumb screw or similar device.

It is an object of the invention to provide a foam nozzle which is simple to manufacture.

It is a further object of the invention to provide a foam nozzle which is inexpensive.

It is a further object of the invention to provide a foam nozzle which is simple to use.

It is a further object of the invention to provide a foam nozzle which can be used with the traditional non-foam nozzle.

It is a further object of the invention to provide a foam nozzle which does a superior job of producing foam as compared to the prior art.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the claims.

DESCRIPTION OF THE PREFERRED EMBODIMENT

Figure 1:
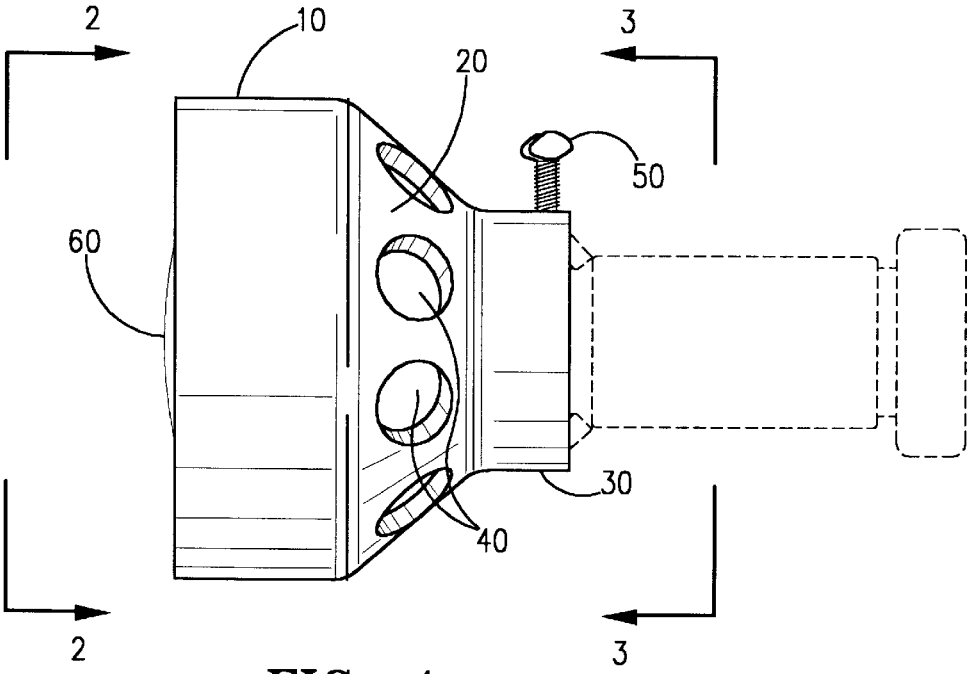
FIG. 1 is side elevational view of the nozzle.

Looking at FIG. 1, we see a side elevation of the nozzle. The nozzle is most inexpensively molded from a hard plastic such as ABS plastic, although it is certainly possible to build the nozzle out other materials, such as polymer, graphite, fiberglass, or a metal such as aluminum. Although the invention has an over-all conical shape, there are actually two straight, cylindrical sections connected by an angled, cylindrical section. Specifically, the nozzle has a forward section, 10, an angled middle section, 20, with a plurality of air holes which are a means for allowing air to enter the nozzle and be mixed with water and a foaming agent, 40, and a back section, 30, with a thumb screw, 50, which is threaded through the back section, 30. In this view we can also see a portion of the front of a double screen, 60. This figure also shows, in dotted lines, a standard non-foam nozzle in order to demonstrate the environment of the present invention. It is anticipated that a firefighter will slip the back section, 30, of the nozzle over a standard non-foam nozzle, and tighten the thumb-screw, 50, to hold the nozzle in place. The thumb screw, 50, is simply one particularly simple and inexpensive way to accomplish this holding task. It would certainly be possible to replace the thumb screw with other holding hardware without departing from the spirit of the present invention.

Figure 2:
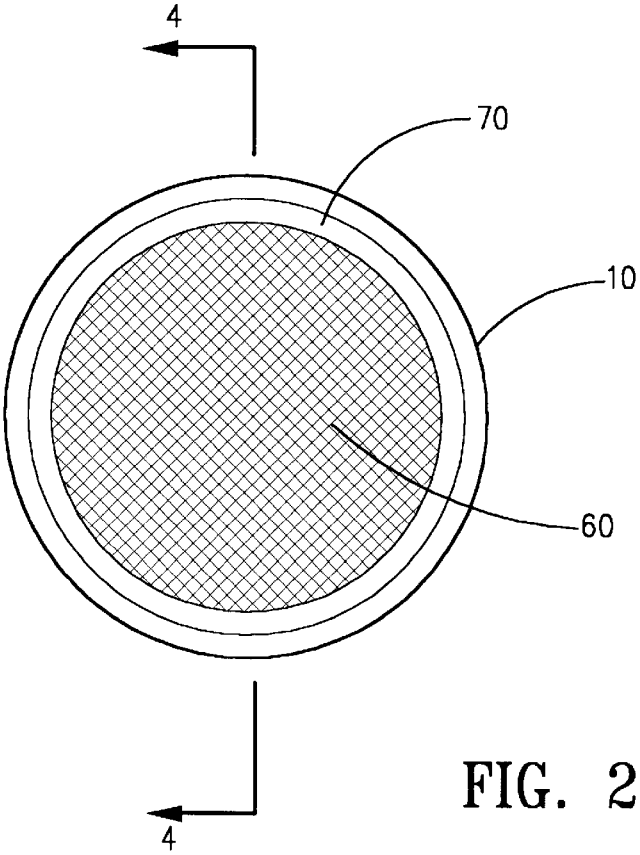
FIG. 2 is front elevational view of the nozzle.

Looking at FIG. 2, we see a front elevation of the nozzle showing the front section, 10, the front of the double screen, 60, and a retaining ring, 70, which holds the screen, 60, inside the front section, 10.

Figure 3:
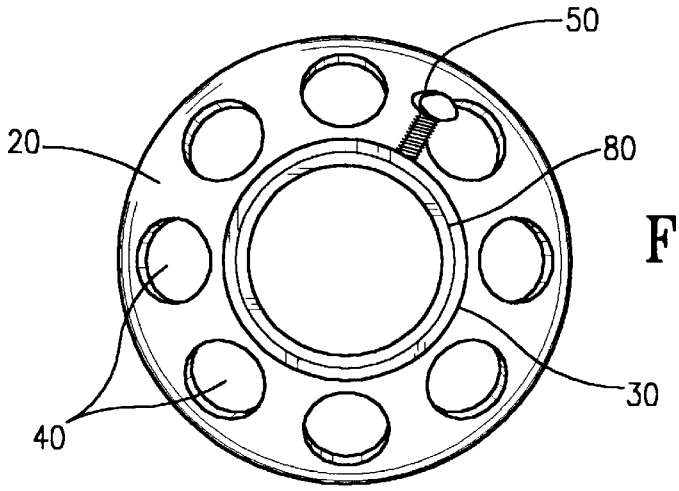
FIG. 3 is a rear elevational view of the nozzle.

In FIG. 3 we see a rear elevation of the nozzle, showing the middle section, 20, with its plurality of air holes, 40, and the back section, 30, with its thumb-screw, 50. This figure shows a lip, 80, inside the back section, 30, for receiving the standard, non-foam nozzle.

Figure 4:
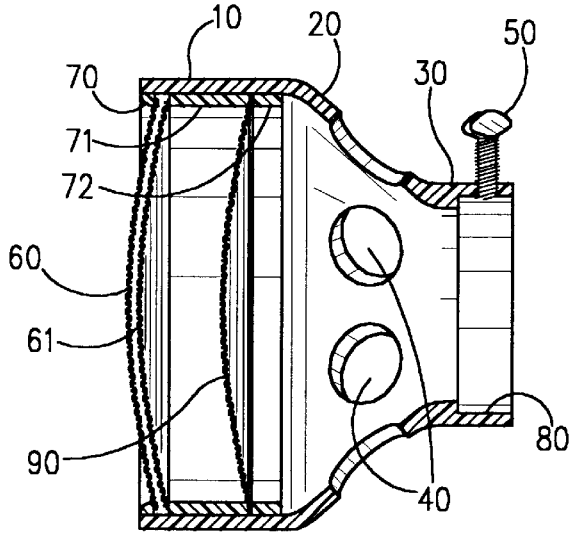
FIG. 4 is a sectional view of the nozzle.

FIG. 4 is a sectional view of the nozzle showing the front section, 10, the middle section, 20, with air holes, 40, the back section, 30, with its thumbscrew, 50, and the front of the double screen, 60. The rear of the double screen, 61, is also visible. From experimentation, it has been found that the best results in foam production can be achieved by having the double screens, 60 and 61, rotated approximately ninety degrees with respect to each other so that the wires of one screen pass over the holes in the other screen, thus increasing the agitation provided by the screens. This figure also shows how the retaining ring, 70, fits inside the front section, 10, and holds both the front, double screen, 60, and 61, against a spacer, 71, a rear screen, 90, and a rear retaining ring, 72 , inside the front section, 10. The retaining rings, 70, 72, and spacer, 71, can be held in place inexpensively by using an adhesive, although it is also possible to hold them in place with removable means such as screws. The screens, 60, 61, and 90, are preferably made of a corrosion resistant metal, such as stainless steel, with a concave shape being desirable. This figure also shows in greater detail the lip, 80, in the back section, 30, which receives the standard, non-foam nozzle. Without limiting the invention to any particular theory, it is believed that this nozzle has two features which allow it to do a better job of producing foam than the prior art. First, the use of screens, 60, 61, and 90, gives a means for producing superior agitation as compared with the prior art. Second, the fact that the front section, 10, is significantly larger than the back section, 30, facilitates the expansion of the foam inside the nozzle. When used with a standard two-inch diameter nonfoam nozzle, the present nozzle would have an overall length of approximately four inches, and the front section, 10, would have an inner diameter of approximately three and seven-eights of an inch.

Figure 5:
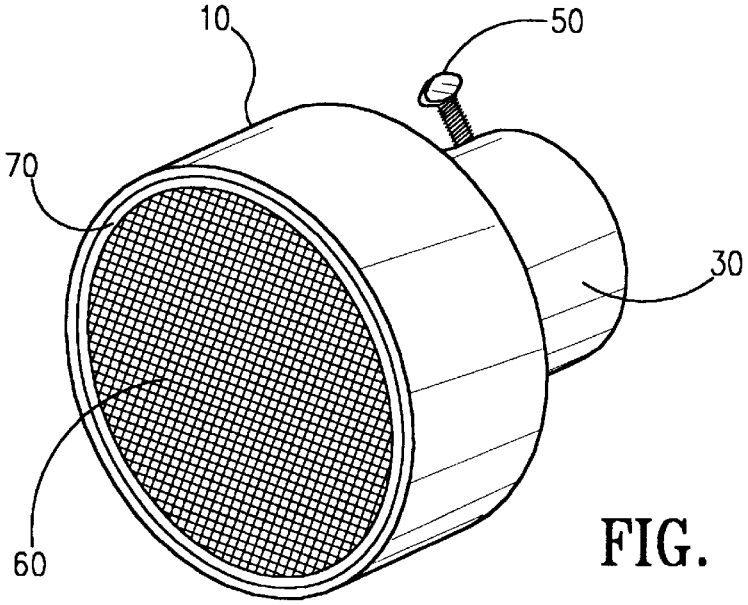
FIG. 5 is perspective view of the invention.

Turning to FIG. 5, we see a perspective view of the nozzle, showing the front section, 10, with the retainer ring, 70, and front of the double screen, 60, as well as the back section, 30, with its thumb-screw, 50.

Each of the elements described above, or two or more together, may also find a useful application in other types of methods differing from the type described above. While certain novel features of this invention have been shown and described and are pointed out in the annexed claims, it is not intended to be limited to the details above, because various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A foam fire fighting nozzle comprising:

a. a straight, cylindrical back section capable of being slidably attached to a standard, non-foam fire fighting nozzle;

b. an angled, cylindrical middle section attached to said back section;

c. means, cooperative with said middle section, for allowing air to enter the nozzle;

d. a straight, cylindrical front section, where the diameter of the front section is larger than the diameter of the back section, attached to said middle section, and where the front section is approximately the same length as the back section;

e. means, cooperative with said front section, for agitating a mixture of air, water and foaming agent.

2. A foam fire fighting nozzle comprising:

a. a straight, cylindrical back section capable of being slidably attached to a standard, non-foam fire fighting nozzle;

b. means, cooperative with said back section, for firmly securing said back section to the standard, non-foam fire fighting nozzle;

C. an angled, cylindrical middle section attached to said back section;

d. means, cooperative with said middle section, for allowing air to enter the nozzle;

e. a straight, cylindrical front section, where the diameter of the front section is larger than the diameter of the back section, attached to said middle section, and where the front section is approximately the same length as the back section;

f. means, cooperative with said front section, for agitating a mixture of air, water and foaming agent.

3. A foam fire fighting nozzle comprising:

a. a straight, cylindrical back section capable of being slidably attached to a standard, non-foam fire fighting nozzle;

b. A thumb-screw, threaded through said back section, capable of engaging the standard, non-foam nozzle.

c. an angled, cylindrical middle section attached to said back section;

d. a plurality of holes in said middle section for allowing air to enter the nozzle;

e. a straight, cylindrical front section, where the diameter of the front section is larger than the diameter of the back section, attached to said middle section, and where the front section is approximately the same length as the back section;

f. a plurality of screens inside said front section for agitating a mixture of air, water and foaming agent, where at least two of the screens are mounted in the front section at an orientation of ninety degrees to each other.

* * * * *